United States Patent [19]

Bestenreiner et al.

[11] 4,049,947

[45] Sept. 20, 1977

[54] METHOD AND ARRANGEMENT FOR PROTECTING SHEETS FROM CHARRING IN COPYING MACHINES

[75] Inventors: Friedrich Bestenreiner, Grunwald; Dieter Giglberger, Unterhaching, both of Germany

[73] Assignee: AGFA-Gevaert, A.G., Leverkusen, Germany

[21] Appl. No.: 665,383

[22] Filed: Mar. 10, 1976

[30] Foreign Application Priority Data

Mar. 15, 1975 Germany ..... 2511423

[51] Int. Cl.[2] ..... H05B 1/00; G03G 15/00; G03G 13/00

[52] U.S. Cl. ..... 219/216; 219/388; 250/319; 432/227

[58] Field of Search ..... 219/216, 388; 355/3; 250/319, 317; 432/59, 227

[56] References Cited

U.S. PATENT DOCUMENTS

| | | | |
|---|---|---|---|
| 3,697,722 | 10/1972 | Furuichi et al. | 219/216 |
| 3,748,088 | 7/1973 | Mooney et al. | 219/216 X |
| 3,920,328 | 11/1975 | Toto | 219/216 |

*Primary Examiner*—C. L. Albritton
*Attorney, Agent, or Firm*—Michael J. Striker

[57] ABSTRACT

In an electro-photographic copier of the type wherein an image is formed on an image-carrying sheet and is thereafter fixed by subjecting the sheet at a fixing station to the influence of heat, a combination comprises a heating arrangement at the fixing station for fixing an image on a sheet, and a conveyor arrangement for advancing the sheet through the station at a predetermined speed sufficient to permit the heating arrangement to fix the image on the sheet. An automatic deactuating timing switch is employed to prevent charring of the sheet in the event that the latter is advanced through the fixing station at a speed lower than said predetermined speed.

10 Claims, 1 Drawing Figure

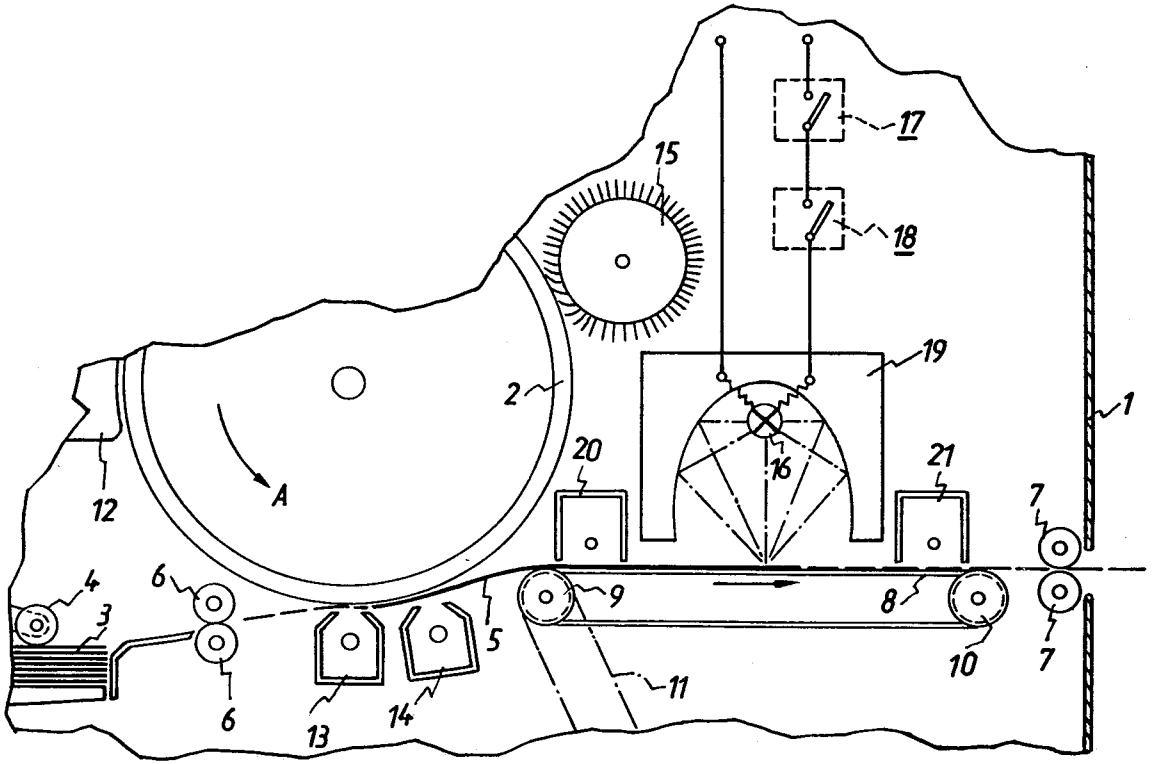
1
7
7
10
21
8
19
17
18
16
15
11
9
20
2
5
14
13
A
6
6
12
4
3

METHOD AND ARRANGEMENT FOR PROTECTING SHEETS FROM CHARRING IN COPYING MACHINES

BACKGROUND OF THE INVENTION p The present invention relates to copying machines and, more particularly, to a method and arrangement for protecting sheets from charring in such copying machines.

Electro-photographic reproducing machines or copiers of the type wherein an image is formed on an image-carrying sheet and is thereafter fixed by subjecting the sheet at a fixing station to the influence of heat are generally known in the art. Since the toner powder and/or the sheet have different optical and thermal characteristics, short bursts of heat energy are used to melt substantially only the toner powder on the sheet without causing the sheet itself to receive any significant amounts of heat which would otherwise damage the sheet. Reflective arrangements are also known which intensify the heat and thereby achieve some savings in input energy.

However, the prior art copiers have not proven altogether satisfactory in preventing the image-carrying sheets from being burned or charred in the event that the sheets take too long to be advanced through the work station where the toner powder is being fixed to the sheet. In particular, on account of the high heat energy density which is further intensified and directed by the reflective arrangement towards a sheet, the sheet tends to char in the event of malfunction; that is, the sheet becomes stuck in the work station or the sheet is simply slowed in its advance through the work station. In either event, the sheet is exposed to heat for too long a time and is damaged, thereby making the reproduced image unsatisfactory.

SUMMARY OF THE INVENTION

Accordingly, it is the general object of the present invention to overcome the disadvantages of the prior art.

An additional object of the present invention is to protect sheets employed in copiers from heat damage.

Yet another object of the present invention is to provide satisfactory image reproductions on image-carrying sheets.

In keeping with these objects, and others which will become apparent hereinafter, one feature of the invention resides, briefly stated, in a method and arrangement in an electro-photographic copier of the type wherein an image is formed on an image-carrying sheet and is thereafter fixed by subjecting the sheet at a fixing station to the influence of heat which comprises: heating means at said station for fixing an image on a sheet; means for advancing the sheet through said station at a predetermined speed sufficient to permit said heating means to fix the image on the sheet; and means for preventing charring of the sheet in the event the latter is advanced through said station at a speed lower than said predetermined speed.

This feature of preventing charring is preferably achieved by providing for an automatic timing switch which is preset at a predetermined time interval for automatically deactuating the heating means after this time interval has elapsed. This time interval is selected to correspond to the time in which a sheet normally takes to advance through the fixing station, that is, when no malfunction has occurred. After this time has passed, the timing switch automatically shuts off the heating means. Thus, in the event that the sheet is still in the fixing station, no additional, undesirable energy will be supplied to the sheet.

Also, in accordance with the invention, the predetermined speed at which the advancing means transports the sheet through the work station is chosen so that the time period during which the sheet is within the station is shorter than the time period in which a stationary sheet begins to char. The minimum speed is the speed at which a sheet still has not yet begun to char; the maximum speed is the speed at which adequate fixing of the toner powder is guaranteed.

Furthermore, the predetermined speed and the fixing efficiency are so chosen that the time, which is required for a sheet to be fixed by toner powder, is so short that in case the sheet remains stationary in the work station, no charring will occur because the heating means will be automatically de-actuated by the timing switch after a predetermined time interval has elapsed.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE illustrates a partial diagrammatic view of a preferred embodiment in accordance with the present invention.

DESCRIPTION OF THE PREFERRED EMBODIMENTS

Referring to the drawing, it will be seen that reference numeral 1 generally identifies a housing of an electro-photographic copier of the type wherein an image is formed on an image-carrying sheet and is thereafter fixed by subjecting the sheet at a fixing station to the influence of heat.

Specifically, a drum 2 is mounted in housing 1 for rotary movement in direction of arrow A. The outer surface of the drum 2 is electrostatically charged in known manner at predetermined locations which correspond to the pattern of the image to be copied. Toner powder which is adapted to melt when subjected to heat, is fed to the outer surface of the drum 2 by the device 12, and the powder is electrostatically attracted to the electrostatically-charged outer surface of the drum 2. The toner powder particles thereby form the image pattern which will be subsequently transferred onto a sheet 5. The electrostatic formation of the image on the drum 2 and the deposition of toner powder thereon, are well known in the art and, consequently, further discussion of these aspects are not believed to be necessary since these features do not form part of the invention.

Likewise, in known manner, a feed roller 4 advances individual sheets 5 from a stack 3 in direction towards the transportation roller pair 6 which advances the sheets 5 towards the drum 2. A first corona-type device 13 generates an electrostatic force which pushes the sheet 5 against the drum 2 so that the toner powder arranged on the outer surface thereof will be transferred onto the sheet 5. A second corona-type device 14 downstream of the first corona-type device 13, as considered in direction of the advancement of a sheet 5 through the housing 1, is operative to generate an electrostatic force which pulls the sheet 5 off the drum 2. A cleaning wheel 15 located downstream of devices 13, 14 removes any powder particles which were not deposited on the sheet 5 and which may still remain on the outer surface of the drum 2.

In order to fix the powder particles in place on the sheet 5, heating means 16 is provided at a fixing station. Preferably, the heating means comprises an elongated lamp, e.g., an iodine quartz lamp. For transporting the sheet through the station, advancing means 8–11 moves the sheet at a predetermined speed which is sufficient to permit the heating means 16 to fix the image on the sheet 5.

The advancing means comprises an endless conveyor belt 8 trained about tension rollers 9, 10. Roller 9 is driven by means of linkage 11 which is connected to a non-illustrated drive so as to advance a sheet 5 in direction of arrow B.

When a sheet 5 enters the fixing station, actuating means or switching device 17 actuates the heating lamp 16 so as to generate the heat energy required to melt and fix the loose powder particles onto the sheet 5. The actuating means 17 may be comprised of any electrical, mechanical, or analogous means. For example, a mechanically actuated key arranged to switch the heating lamp into an operative position when the sheet 5 is located at a predetermined position in the work station may be employed. Alternatively the actuating means 17 may be comprised of a photo-electrical circuit which switches the lamp 16 into an operative position when the sheet 5 interrupts a light beam which is directed across the path of the advancing sheet.

The light and heat radiated by the lamp 16 is concentrated and intensified by the elliptically shaped cylindrical reflector 19. The lamp 16 is positioned in one focal line of the ellipse and is transversely spaced from the advancing sheet 5 a distance substantially corresponding to the distance between the focii of the ellipse. Thus, the energy is focussed onto the upper surface of sheet 5 or, more precisely, onto the powder-deposited layer formed on the sheet 5. In order to increase the concentration of the energy, the inner surface of the reflector 19 may be polished and be further provided with a reflective mirror-like coating.

Additional corona-type devices are provided on opposite sides of the fixing station. Device 20 is operative for holding the sheet 5 down onto the conveyor belt 8 during the fixing operation. Device 21 is operative for picking up the sheet 5 from the conveyor belt so that the sheet 5 can be advanced towards the transport roller pair 7 and be thereafter conveyed out of the housing 1.

In accordance with the invention, means 18 is provided for preventing charring or burning of the sheet 5 due to the high heat energy being focussed onto the sheet 5 in the event that the sheet 5 is advanced through the station at a speed less than the aforementioned predetermined speed. In other words, the anti-charring means 18 is operative in the event that the advancing means 8–11 should malfunction for any reason and either advance a sheet more slowly than would be expected in normal operation or break-down completely and not move the sheet at all. In either event, the sheet 5 is exposed to more heat than was previously anticipated under normal operation, and the function of the means 18 is to protect the sheet from burning due to this additional, undesirable heat exposure.

Anti-charring means 18 is comprised of any means for automatically de-actuating the heating lamp 16 after a predetermined time interval has elapsed. This time interval is selected so as to permit the advancing means to advance the sheet at a predetermined speed through the fixing station and fix the powder to the sheet without also exposing the sheet itself to heat damage.

A preferred example of such automatic deactuation is a timing switch which is pre-set at this predetermined time duration to turn off the lamp 16 after this predetermined time duration has elapsed. Such a switch may be mechanically actuated to shut off the lamp 16 after the predetermined time has passed, or may be actuated by any electric circuitry such as conventional delay-type circuitry. For example, resistive and capacitive elements having a time constant substantially equal to this predetermined time duration may be selected and connected with the heating means 16 to shut off the lamp 16 after the predetermined time has elapsed.

It is also possible if the sheet 5 has a heat capacity which is an order of magnitude higher than that of the toner powder and if the absorption characteristic of the sheet is an order of magnitude less than that of the toner powder. In other words, the amount of heating energy required for melting the toner powder can be increased on the order of 2 times before the heat would otherwise damage the sheet itself.

It will be understood that each of the elements described above, or two or more together, may also find a useful application in other types of constructions differing from the types described above.

While the invention has been illustrated and described as embodied in a method and arrangement for protecting sheets from charring in copying machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an electro-photographic copier of the type wherein an image is formed on a image-carrying sheet and is thereafter fixed by subjecting the sheet at a fixing station to the influence of heat, a combination comprising heating means at said station for fixing an image on a sheet; means for advancing the sheet through said station at a predetermined speed sufficient to permit said heating means to fix the image on the sheet; and means for preventing charring of the sheet in the event that the latter is advanced through said station at a speed lower than said predetermined speed, said preventing means including a timing switch set at a predetermined time duration sufficient to permit said advancing means to advance the sheet at said predetermined speed through said station, and operative for automatically de-actuating said heating means after said predetermined time duration has elapsed.

2. In an electro-photographic copier of the type wherein an image is formed on an image-carrying sheet and is thereafter fixed by subjecting the sheet at a fixing station to the influence of heat, a combination comprising heating means at said station for fixing an image on a sheet; means for advancing the sheet through said station during a predetermined time period which begins and ends when the sheet respectively enters and exits said station and which is sufficient to permit said heating means to fix the image on the sheet without charring the latter during normal operation of the copier; and means for preventing charring of the sheet in the event that the latter is located in said station after a time longer than said predetermined time period, said preventing means including timing means for setting a predetermined time interval which begins when the sheet enters said station and which exists for a time longer than said predetermined time period but less than the time after which charring tends to occur, and also operative for automatically de-actuating said heating means after said predetermined time interval has elapsed.

3. A method of protecting image-carrying sheets in an electro-photographic copier of the type wherein an image is formed on a sheet and is thereafter fixed by subjecting the latter at a fixing station to the influence of heat, comprising the steps of supplying image-fixing heat energy at the station; advancing the sheet through the station during a predetermined time period which begins and ends when the sheet respectively enters and exits the station and which is sufficient to permit the image to be fixed by the heat energy without charring the sheet during normal operation of the copier; and preventing charring of the sheet in the event the latter is located in the station after a time longer than said predetermined time period, said preventing step including the step of setting a predetermined time interval which begins when the sheet enters the station and which exists for a time longer than said predetermined time period but less than the time after which charring tends to occur, and the step of terminating the supply of heat energy to the sheet upon expiration of said predetermined time interval irrespective of whether or not the sheet has left the station.

4. A combination as defined in claim 2; and further comprising actuating means for actuating said heating means when a sheet enters said station.

5. A combination as defined in claim 2, wherein said heating means radiates light and heat energy; and further comprising means for concentrating said energy on a sheet for fixing an image thereon.

6. A combination as defined in claim 2, wherein said advancing means advances the sheet at a predetermined speed sufficient to fix the image on the sheet and also prevent the latter from incurring heat damage due to the heating by said heating means.

7. A combination as defined in clam 2, wherein said timing means comprises a timing switch set at said predetermined time interval sufficient to permit said advancing means to advance the sheet at a predetermined speed through said station.

8. A combination as defined in claim 2, wherein said heating means is a stationary radiating lamp fixedly mounted to the copier, and wherein said advancing means moves the sheet relative to said stationary lamp.

9. A method as defined in claim 3, wherein said terminating step includes the step of automatically shutting off heat energy being supplied to the sheet after said predetermined time interval has elapsed.

10. A method as defined in claim 3, wherein said step of advancing is performed by advancing the sheet at a predetermined speed sufficient to fix the image on the sheet and also prevent the latter from incurring heat damage.

* * * * *